US005899160A

United States Patent [19]

Hoag

[11] Patent Number: 5,899,160

[45] Date of Patent: May 4, 1999

[54] PUFF QUILT SQUARE MAKER AND METHOD FOR USING

[76] Inventor: Barbara Jones Hoag, 1347 Valley Home Rd., Dandridge, Tenn. 37725

[21] Appl. No.: 08/922,209

[22] Filed: Sep. 2, 1997

[51] Int. Cl.[6] ..... D05C 17/00

[52] U.S. Cl. ..... 112/475.22; 112/119; 112/103; 112/470.17; 112/439; 53/452

[58] Field of Search ..... 112/102, 103, 112/118, 119, 146, 150, 153, 475.08, 470.17, 475.22, 475.21, 439; 223/35, 28; 428/101, 102, 103, 104; 53/452, 469; 5/502

[56] References Cited

U.S. PATENT DOCUMENTS

| | | | |
|---|---|---|---|
| 390,300 | 10/1888 | Fox | 5/502 |
| 4,506,616 | 3/1985 | Nixon | 112/262.1 |
| 4,563,785 | 1/1986 | Samelson . | |
| 4,690,084 | 9/1987 | Krieger . | |
| 4,774,778 | 10/1988 | Williams . | |
| 4,814,218 | 3/1989 | Shane . | |
| 5,141,140 | 8/1992 | Moffett-Hall . | |
| 5,144,899 | 9/1992 | Allen | 112/103 |
| 5,186,998 | 2/1993 | Eugster . | |
| 5,291,843 | 3/1994 | Hori . | |
| 5,707,709 | 1/1998 | Blake | 428/102 |
| 5,749,149 | 5/1998 | Claytor | 33/1 F |

*Primary Examiner*—John J. Calvert
*Assistant Examiner*—Tejash D Patel
*Attorney, Agent, or Firm*—Pitts & Brittian, P.C.

[57] ABSTRACT

A puff quilt square maker and method for fabricating a puff quilt square for use in fabricating a quilt or other similar article, such as a child's book, clothing, or decorative article. The puff quilt square maker is used to fabricate puffs in quitting of various shapes and sizes, including the size of the design and the height of the puff, in order to fabricate virtually any design in soft sculpture. A gathering guide is used to gauge each gathered edge of a piece of fabric. The gathering guide is provided with a first slit for receiving and holding one end of the thread used to gather the fabric and a plurality of second slits for receiving and holding a further portion of the thread. The puff quilt square maker includes a core and a guide ring for fabricating a puff. The fabric is placed over the core, with a reference mark positioned over the center of the core. After the fabric has been aligned with the core, the guide ring is slipped over the fabric to the bottom extent of the core. The fabric, while maintained over the core with the guide ring, is then sewn to secure the gathers formed around the base of the core. After the entire circuit around the guide ring is sewn, the guide ring is removed from about the core and the core is withdrawn from the puff In order to shape the puff, a stuffing is inserted through the opening formed in the previous step. The puff quilt square is completed by attaching the puff quilt square face to a backing. In order to achieve sculpting effects to simulate a particular article, the puff is embroidered. Upon completion of the required number of the puff quilt squares, the puff quilt squares are incorporated into the quilt or other article.

21 Claims, 11 Drawing Sheets

PUFF QUILT SQUARE MAKER AND METHOD FOR USING

TECHNICAL FIELD

This invention relates to the field of quilting. More specifically, this invention relates to a device for making a puff quilt square and a method for using the same.

BACKGROUND ART

It is well known that quilting has been an established art for many years. Quilts have been made for many years for many purposes. Practically, quilts are used for providing warmth while seated, or while asleep. More artistically, quilts are used for decorative purposes. While quilts can be readily purchased for either of these purposes, it is often desirable for one to make their own quilts as either heirlooms or gifts. Because of this, hand-made quilts are known to be high in value.

Various factors lend to the value of a quilt. Included are the quality of the quilting (i.e., uniformity of the stitching, quality of the fabric, etc.), the selection of colors, and the pattern. Many standard patterns have been used for many years. Typically, however, the standard patterns are merely for fabricating a flat quilt. Features not typically found on quilts include raised patterns, or three-dimensional soft sculpture.

There have been devices produced for use in various needlework arts. Typical are those devices disclosed in the following U.S. Patents:

| U.S. Pat. No. | Inventor(s) | Issue Date |
|---|---|---|
| 4,563,785 | S. Samelson | Jan. 14, 1986 |
| 4,690,084 | D. Krieger | Sept. 1, 1987 |
| 4,774,778 | T. Williams | Oct. 4, 1988 |
| 4,814,218 | B. Shane | Mar. 21, 1989 |
| 5,141,140 | D. J. Moffett-Hall | Aug. 25, 1992 |
| 5,186,998 | J. R. Eugster | Feb. 16, 1993 |
| 5,291,843 | M. Hori | Mar. 8, 1994 |

Of these, the device disclosed by Samelson ('785) and the method disclosed by Krieger ('084) are each related to a finished product having a "puffed" design. The '785 device includes a device for stitching a circular pattern into two layers of fabric having a foam rubber core interposed therebetween. The resulting pattern is a simulated button. The '084 method is disclosed for use in mass production of a quilted product wherein the quilting is accomplished by a prescribed embroidered design. A puffed design is accomplished by sewing two pieces of fabric together, with one having a high shrinking tendency. The embroidered composite fabric is then subjected to hot water treatment in order to shrink the back fabric relative to the front fabric, thereby resulting in the puffed design. In each of these disclosures, a "puff" design is accomplished merely as a result of the stitching of two layers of fabric. These disclosures do not teach a device or method for pre-forming a desired puff in order to accomplish a selected soft-sculpture. Nor do these disclosures teach a device or method for making a puff-style applique for attaching to a quilt pattern.

This devices disclosed by Williams ('778) and Hori ('843) are each adapted for use with an embroidery hoop. The '778 device is provided for aligning a fabric prior to securing the fabric in the hooping frame. The '843 device is an attachment structure for removably attaching a workpiece holder to a movable portion of a sewing machine used for embroidering materials. The attachment structure is used to move an embroidery hoop relative to the needle of a sewing machine. Although each of these devices is associated with an embroidery hoop, neither teaches a device used to form a selected pattern around which is sewn a stitch line. On the contrary, each device teaches the use of an embroidery hoop for the purposes of stretching fabric on which is embroidered a particular pattern.

The device disclosed by Shane ('218) is a quilted craft article, and a method and kit for making the same. However, the '218 device does not disclose the use of a puffed design in association with the quilted article. Nor does the '218 device disclose a device or method for making a puffed article for use in quilting.

Moffett-Hall ('140) discloses a device for making fabric appliques. The '140 device is comprised primarily of a base plate, a shape plate, and a template. The base plate is a continuous member upon which is mounted the shape plate. The shape plate defines at least one opening with a selected configuration. The template is configured to be closely received within the opening defined by the shape plate. A piece of fabric is placed within the opening after which the template is inserted therein. The edges of the fabric are then flattened over the template such as by ironing. The product is a uniformly shaped applique. However, once the template is removed, there is no definite shape that the applique must retain. For example, for some materials, ironing will not cause the fabric to retain its shape.

The device disclosed by Eugster ('998) is a duplex filter cloth for chamber type filters. The '998 device is fabricated from two pieces of fabric each having an opening formed in a central region thereof, and a collar defined about the central opening. The collars of each piece of fabric are oriented toward one another and are sewn together. However, the '998 device does not teach the manufacture of a puffed element for use with quilting.

Although there are several devices which are used to manufacture various sewn products, embroidered goods, and some specifically for use in quilting, the above-referenced devices fail to teach the manufacture of a puffed article for us in making a quit,. Further, the prior art of record does not teach a means for making a sewn product having a selected depth and outline.

Therefore, it is an object of this invention to provide a means for manufacturing a puffed article for use in association with the manufacture of a quilted article.

Another object of the present invention is to provide a device whereby the puffed article defines a selected outline and a selected depth.

Still another object of the present invention is to provide a device whereby the puffed article is manufactured as a unit and sewn into the quilted article.

DISCLOSURE OF THE INVENTION

Other objects and advantages will be accomplished by the present invention which serves to fabricate a puff quilt square for use in fabricating a quilt or other similar article, such as a child's book, clothing, or decorative article. The puff quilt square maker is used to fabricate puffs in quilting of various shapes and sizes, including the size of the design and the height of the puff, in order to fabricate virtually any design in soft sculpture.

One or more puffs may be fabricated in a single puff quilt square to simulate any selected figure. In order to fabricate a puff in a puff quilt square, a piece of fabric is first selected. At least one pre-determined location is marked with a reference mark prior to gathering the edges such that the puff may be aligned on the square. Each edge of the fabric is gathered in order to create a textured look. A gathering guide is used to gauge each gathered edge. The gathering guide is provided with a first slit for receiving and holding one end of the thread used to gather the fabric. A plurality of second slits is provided for receiving and holding a further portion of the thread, The second slits are disposed along the length of the gathering guide at pre-selected distances from the first slit. A measuring guide is provided for determining the distance between the first slit and each individual second slit. Thus, depending upon the length of the fabric edge to be gathered, and the amount of gather desired, a particular second slit is selected. The thread is then stitched in the fabric along an edge. After the thread has been stitched, the fabric is gathered and the opposite ends of the thread are inserted into the first slit and the selected second slit. The fabric is then adjusted to provide a consistent gather between the first and second slits and the thread is knotted at each slit. The fabric is then removed from the gathering guide and the process is repeated for each edge.

The puff quilt square maker includes a core and a guide ring for fabricating a puff. The diameter of the guide ring is slightly larger than the outside diameter of the core, with a tolerance provided to accommodate several thicknesses of the fabric. The fabric is placed over the core, with the reference mark positioned over the center of the core. After the fabric has been aligned with the core, the guide ring is slipped over the fabric to the bottom extent of the core. Any slack in the fabric is pulled out to ensure that the puff is properly formed. The fabric, while maintained over the core with the guide ring, is then sewn to secure the gathers formed around the base of the core. After the entire circuit around the guide ring is sewn, the guide ring is removed from about the core and the core is withdrawn from the puff.

In order to shape the puff, a stuffing is inserted through the opening formed in the previous step. The puff quilt square is completed by attaching the product of the previous step to a backing. In order to achieve sculpting effects to simulate a particular article, the puff is embroidered. Embroidery stitches are applied through the puff, the stuffing material, and the backing material. Several embroidery stitches are applied to fasten selected spots of the puff to simulate a rose. En order to accomplish identical puffs, a template may be used to mark each embroidery location. Any embroidery pattern may be used to simulate facial features, clothing features, or any other adornment.

Under completion of the required number of the puff quilt squares, the puff quilt squares are incorporated into the quilt or other article. In the event of a quilt, two puff quilt squares are placed right side together and then sewn together along one edge. The puff quilt squares are then unfolded to reveal the individual puffs. This method is repeated until the face of the quilt is completed. A quilt backing and a quilt batting are then placed under the quilt face and sewn in a conventional manner.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A puff quilt square maker incorporating various features of the present invention and a method for using the same are illustrated generally in the figures. The puff quilt square maker and method for using is provided for fabricating a puff quilt square 10 for use in fabricating a quilt or other similar article, such as a child's book, clothing, or decorative article. The puff quilt square maker is used to fabricate puffs 12 in quilting of various shapes and sizes, including the size of the design and the height of the puff 12, in order to fabricate virtually any design in soft sculpture.

Figure 13B:
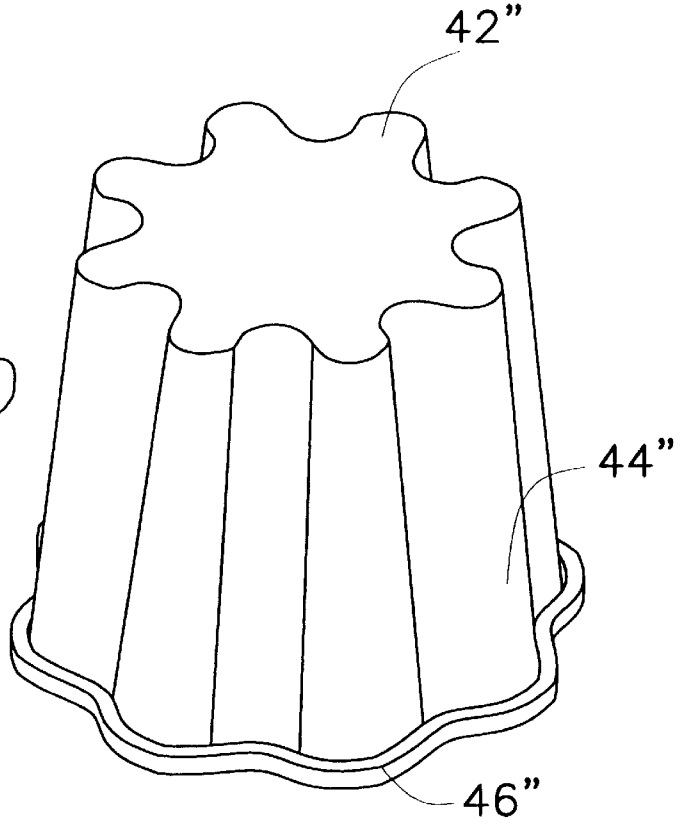
Figure 13A:
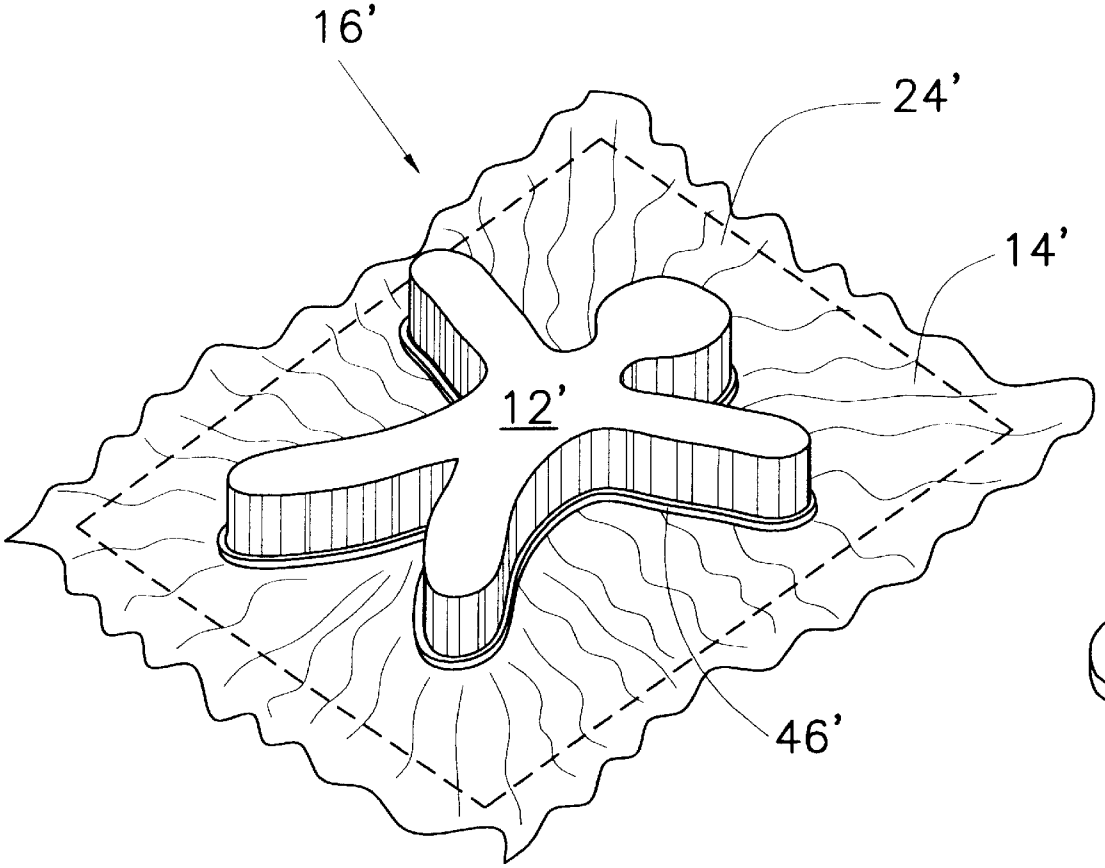

The method of manufacturing a puff quilt square be having one puff 12 is illustrated in detail in FIGS. 1 through 8. The illustrated puff is fabricated to resemble a rose. Although a single puff 12 is illustrated, it will be understood that more than one puff 12 may be fabricated and used in association with a single quilt square 10 in order to assimilate various other plants, animals, or other objects. For example, three puffs 12 may be fabricated, with two of equal size yet smaller than the third, the larger puff 12 embroidered to resemble an animal face and the two smaller puffs 12 being embroidered to resemble ears of the animal. As illustrated in FIGS. 13*a* and 13*b*, as will be discussed below, puffs 12 of various configurations may be easily accomplished. Accordingly, it will be seem by one skilled in the art that the variations of puffs 12 which may be fabricated using the device of the present invention are limited only to one's imagination.

Figure 1:
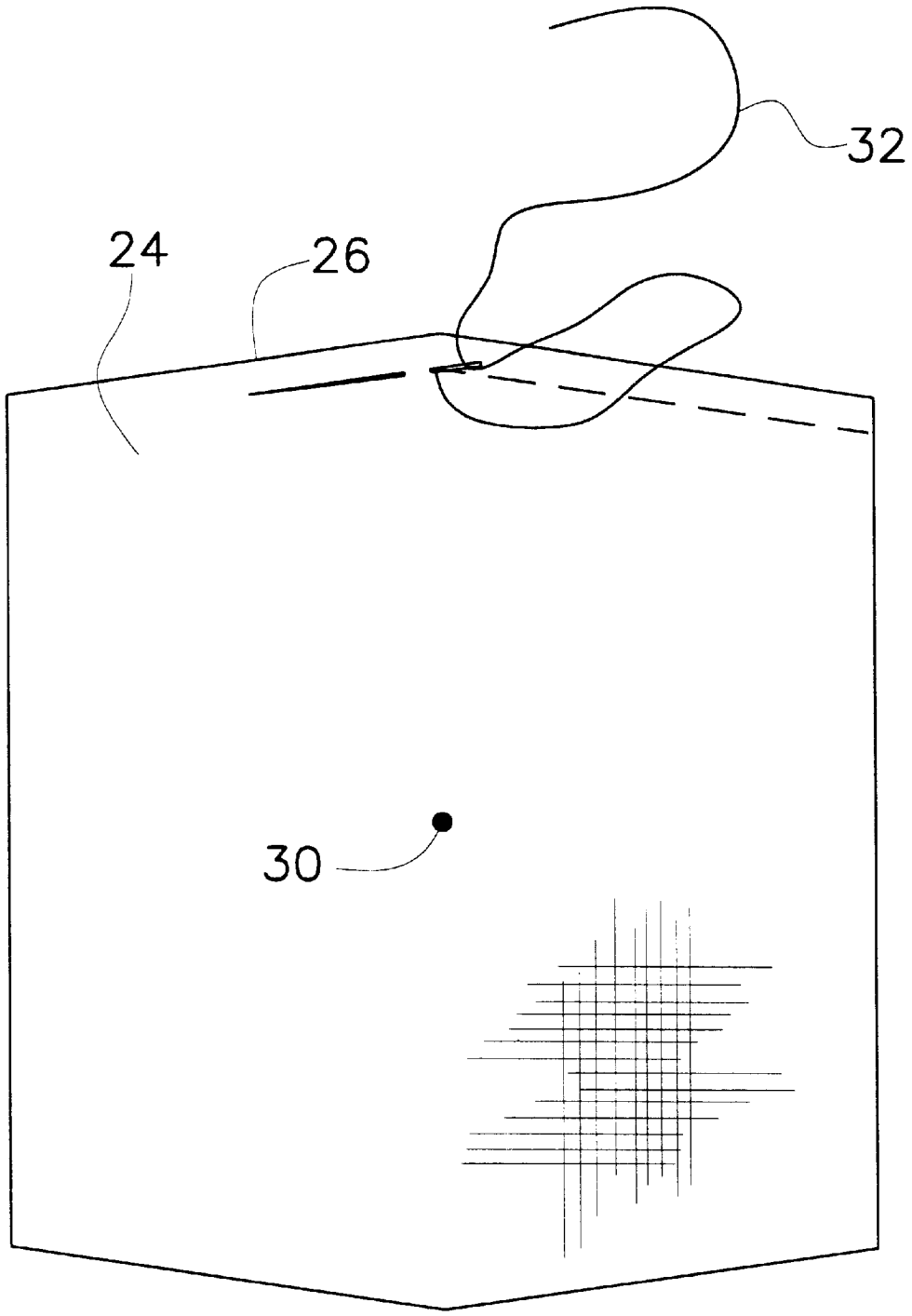
FIG. 1 illustrates a piece of fabric from which a puff quilt square is to be made.

Illustrated in FIG. 1, is a piece of fabric 24, to be used for fabricating a puff quilt square 10. Each edge 26 of the fabric 24, is gathered in order to create a textured look. In order to best accomplish the gathers 28, such is performed prior to the fabrication of the puff 12. As illustrated, the fabric 24, in the preferred embodiment defines two edges substantially parallel to each other and two edges each defining a "V" shaped configuration. The "V" shaped configuration accommodates for the effects of the gathering such that the finished square is substantially flat. The center of the fabric 24 is marked with a reference mark 30 prior to gathering the edges 26 such that the puff 12 may be centered on the square. Et will be recognized that after the gathers 28 have been made, it is difficult to find the exact center of the fabric 24. It will also recognized that a puff 12 may be fabricated at any location on the fabric 24. Accordingly, the mark 30 may be made at any other location such that location of the puff 12 is made easier after the gathers 28 have been fabricated.

Figure 2A:
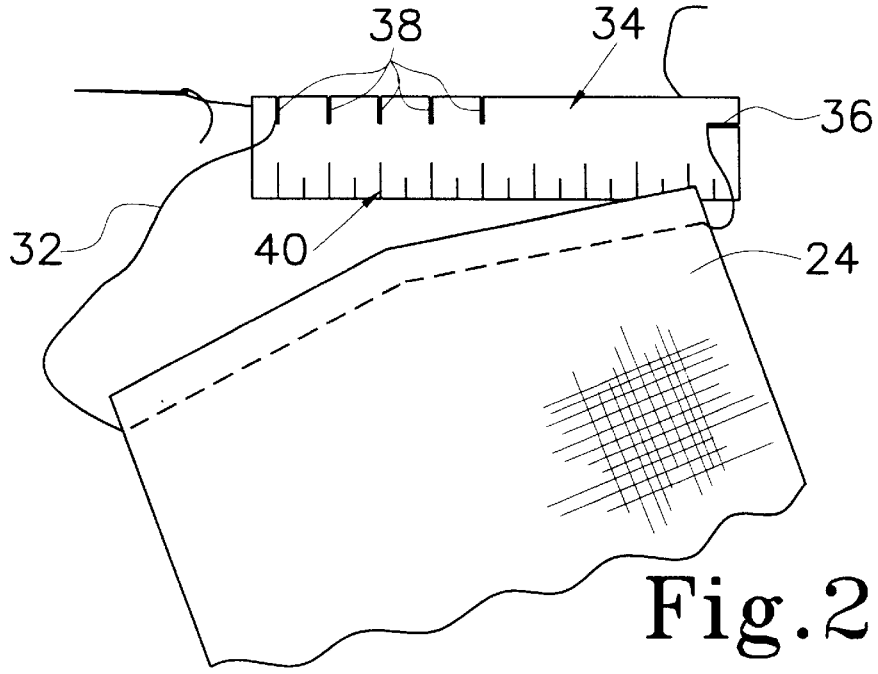
FIGS. 2*a*, 2*b* and 2*c* illustrate various stages of fabrication of a quilt square, from gathering the first side of the fabric using a gathering guide to a fabric square having four gathered sides.
Figure 2B:
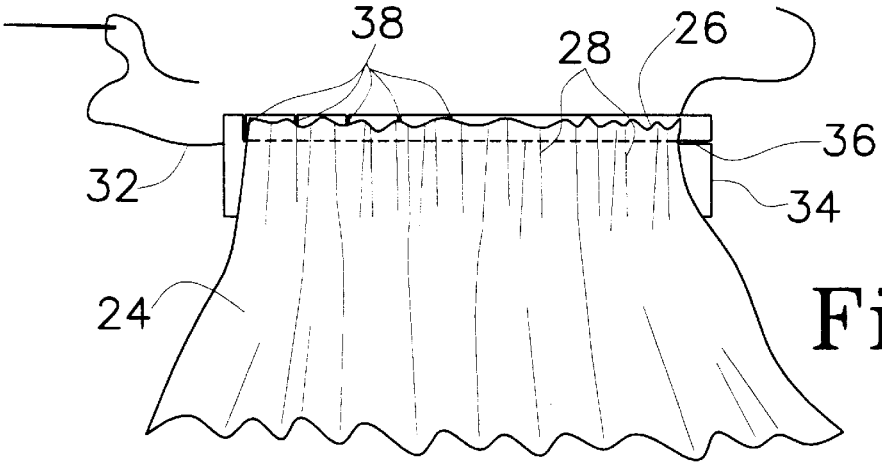
Figure 2C:
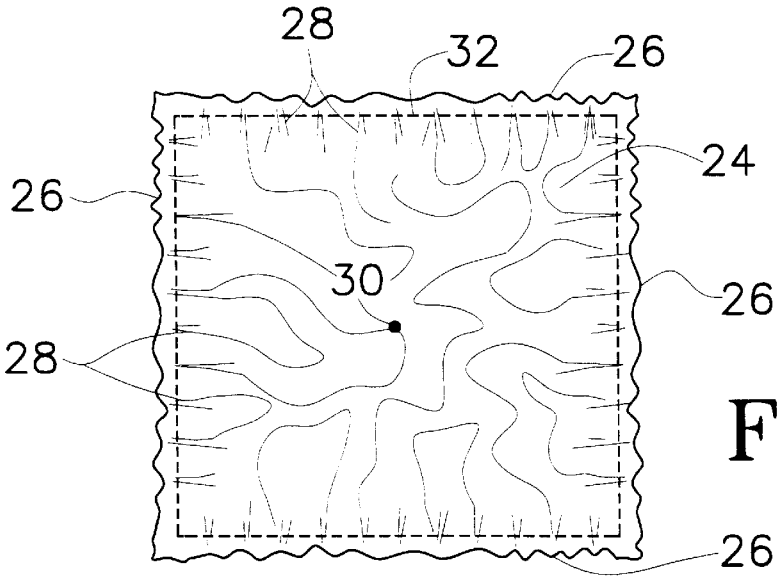

FIGS. 2*a*–2*c* illustrate a preferred method of accomplishing each gathered edge 26. A gathering guide 34 is used to gauge each gathered edge 26. The gathering guide 34 is provided with a first slit 36 for receiving and holding one end of the thread 32 used to gather the fabric 24. A plurality of second slits 38 is provided for receiving and holding a further portion of the thread 32. The second slits 38 are disposed along the length of the gathering guide 34, at pre-selected distances from the first slit 36. A measuring guide 40 is provided for determining the distance between the first slit 36 and each individual second slit 38. Thus, depending upon the length of the fabric edge 26 to be gathered, and the amount of gather 28 desired, a particular second slit 38 is selected. The thread 32 is then stitched in the fabric 24 along the edge 26 as illustrated in FIG. 1. After the thread 32 has been stitched, the fabric 24 is gathered and the opposite ends of the thread 32 are inserted into the first slit 36 and the selected second slit 38, as in FIG. 2*a*. The fabric 24 is then adjusted to provide a consistent gather 28 between the first and second slits 36,38 and the thread 32 is knotted at each slit 36,38, as in FIG. 2*b*. The fabric 24, is then removed from the gathering guide 34 and the process is repeated for each edge 26, as illustrated in FIG. 2*c*.

Figure 3B:
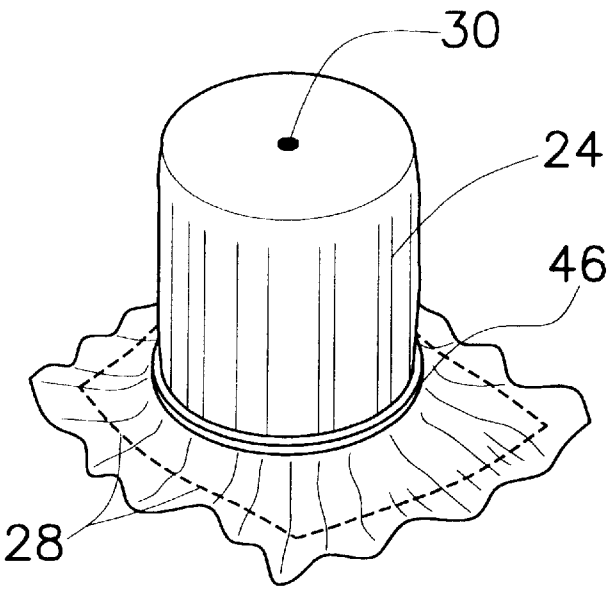
FIGS. 3*a* and 3*b* illustrate the implementation of a core and guide ring for forming the puffed portion of the quilt square.
Figure 3A:
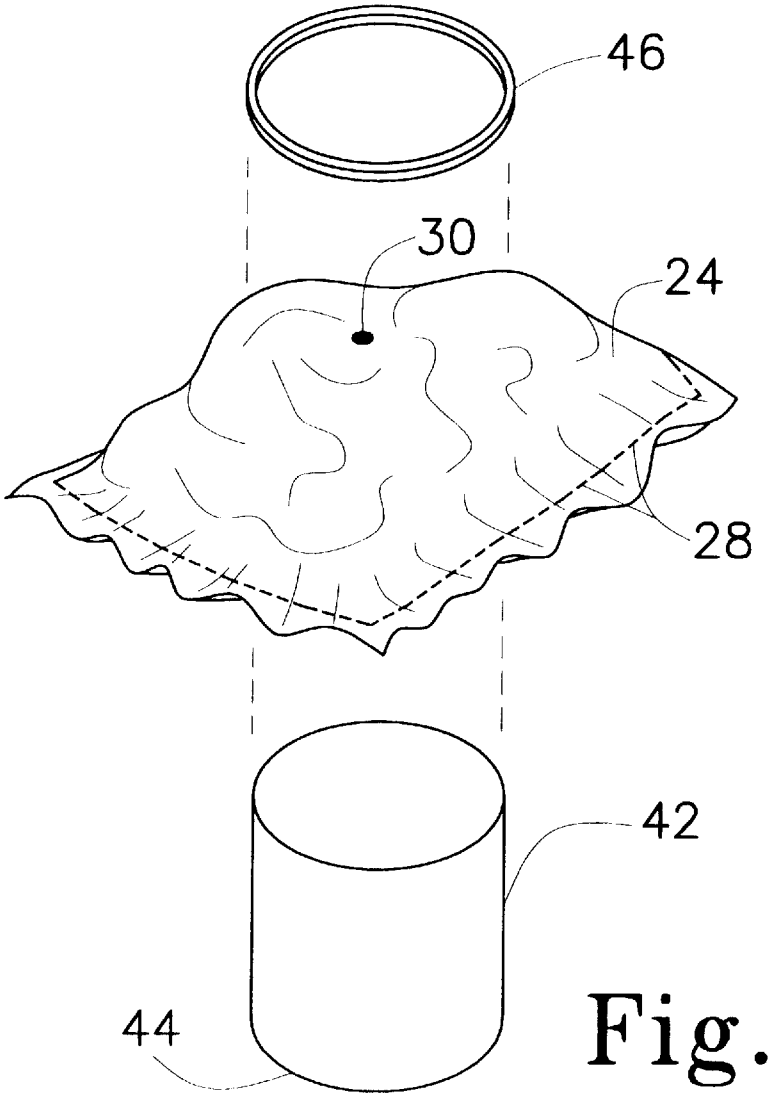

FIG. 3*a* illustrates the use of a core, 42 and a guide ring 46 for fabricating a circular puff 12. While the diameter of the core 42 and guide ring 46 determine the size of the base of the puff 12, the height of the core 42 determines the height and breadth of the puff 12. The diameter of the guide ring, 46 is slightly larger then the outside diameter of the core 42, with a tolerance provided to accommodate several thicknesses of the fabric 24. As illustrated in FIG. 3*a*, the fabric 24 is placed over the core 42, with the reference mark 30 positioned over the center of the core 42. For a core 42 and guide ring 46 of a different configuration, it may will be recognized that more than one reference mark 30 may be necessary in order to insure the desired alignment of the fabric 24 with the core 42. After the fabric 24 has been aligned with the core 42, the guide ring 46 is slipped over the fabric 24 to the base 44 of the core 42. Any slack in the fabric 24 is pulled out to ensure that the puff 12 is properly formed.

Figure 4B:
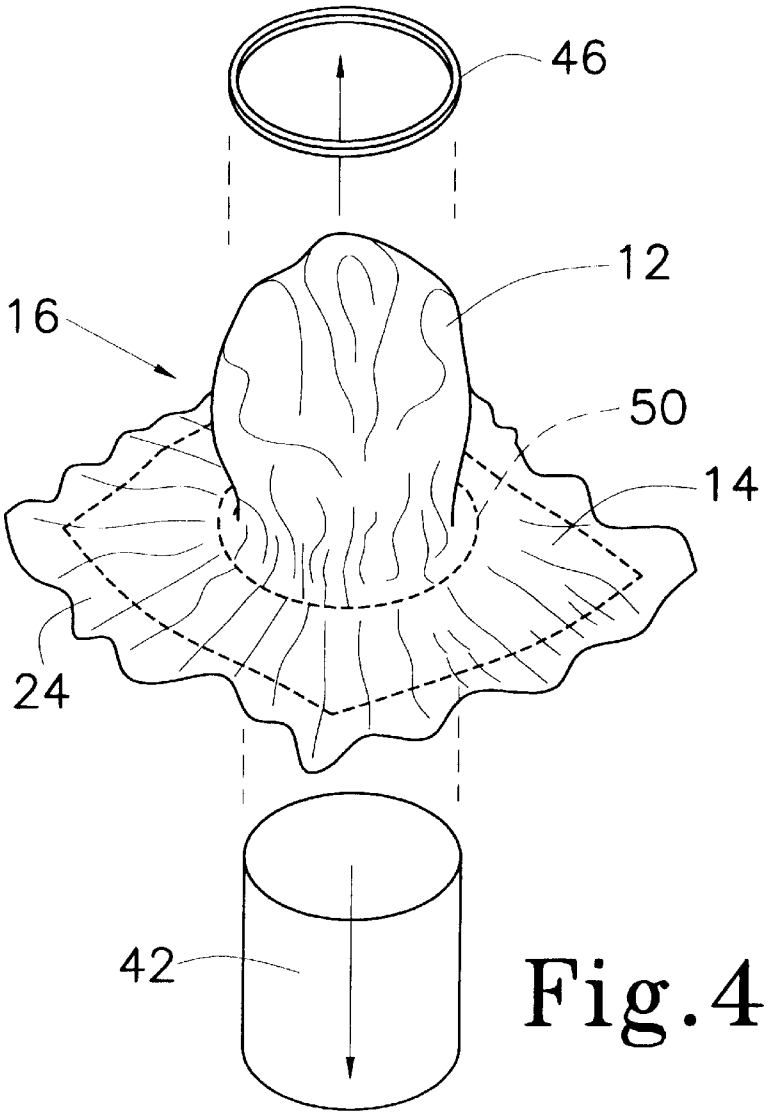
FIGS. 4*a* and 4*b* illustrate the fabrication of the sewn perimeter of the puff portion of the quilt square.
Figure 4A:
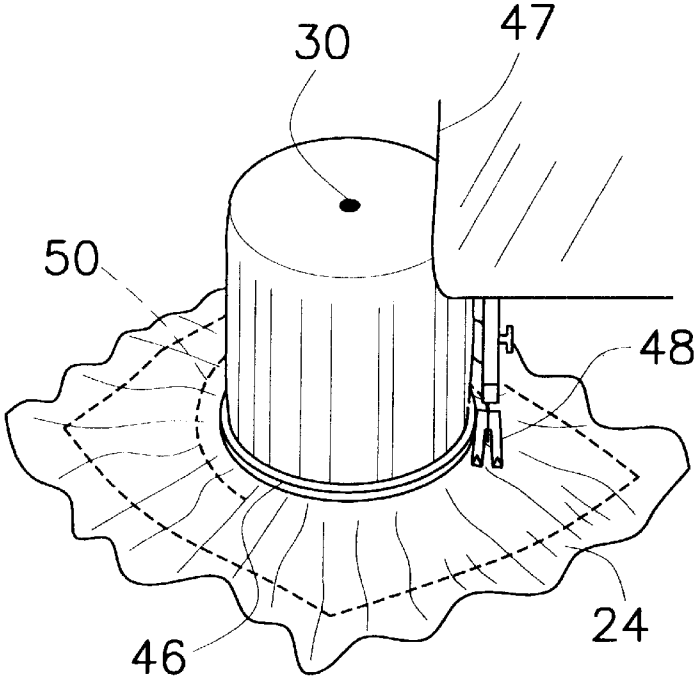

The fabric 24, while maintained over the core 42 with the guide ring 46, is then sewn as illustrated at 50 to secure the gathers formed around the base 44 of the core 42. This is performed as illustrated in FIG. 4*a* using a conventional sewing machine 47 by positioning the guide ring 46 proximate the sewing foot 48 and rotating the fabric 24, while continuously maintaining the guide ring 46 next to the sewing foot 48. After the entire circuit around the guide ring 46 is sewn, the guide ring 46 is removed from about the core 42 and the core 42 is withdrawn from the puff 12, as illustrated in FIG. 4*b*.

Figure 5:
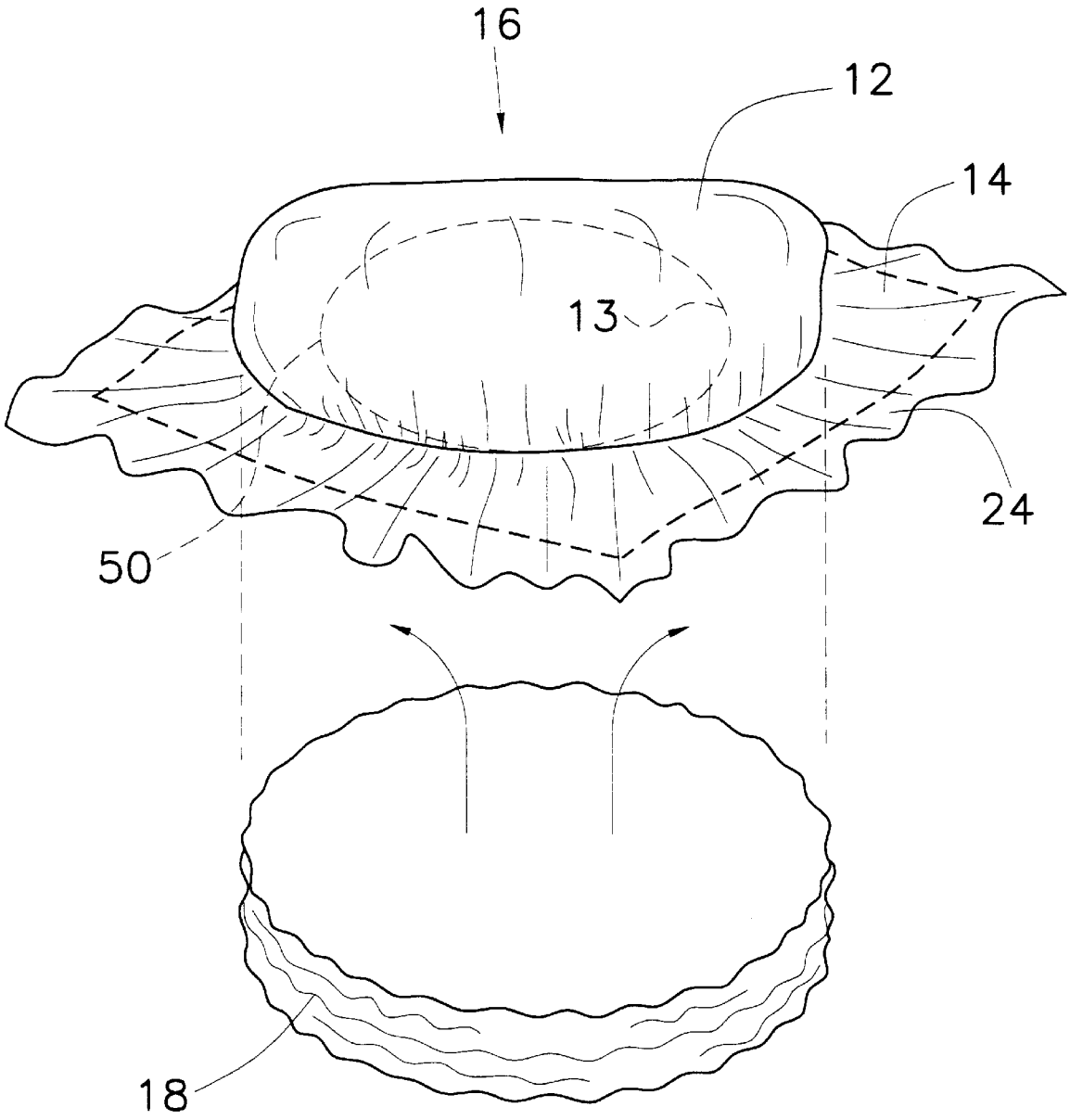
FIG. 5 illustrates the insertion of a filler material into the puff portion of the quilt square.
Figure 6B:
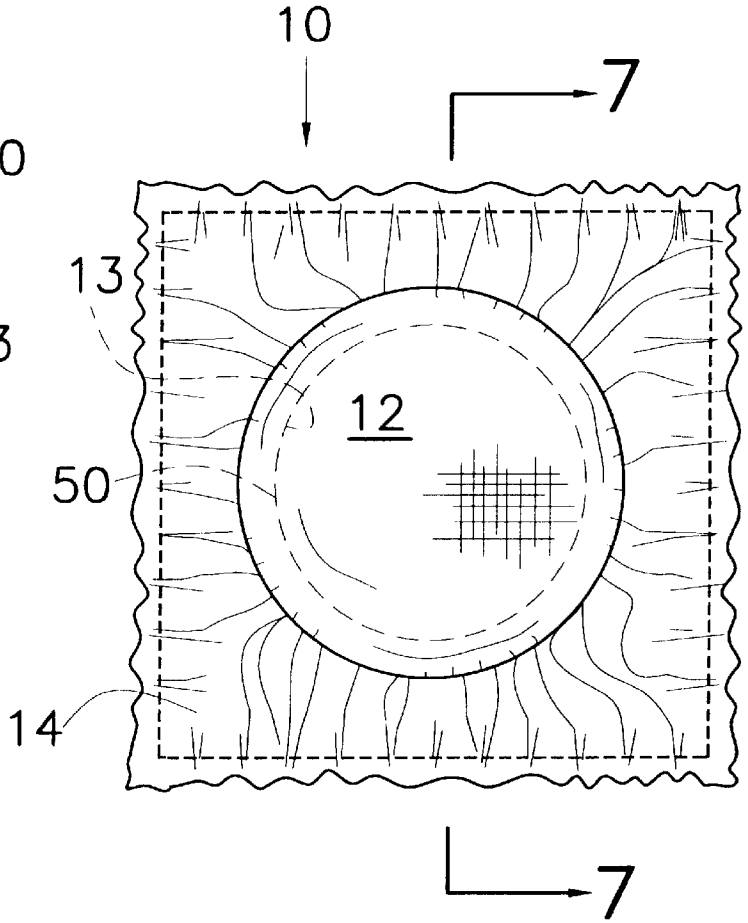
FIGS. 6*a* and 6*b* illustrate the assembly of a puff quilt square face.
Figure 6A:
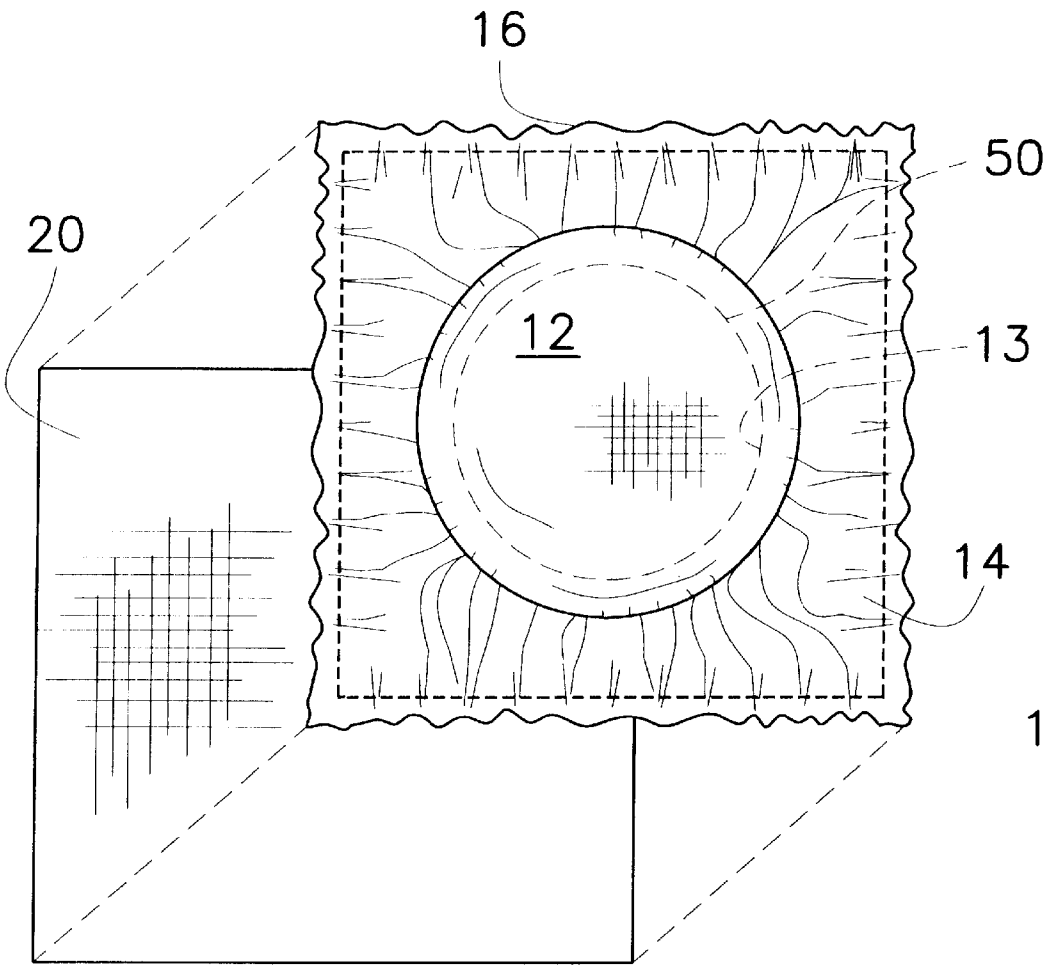

In order to shape the puff 12, a stuffing 18 is inserted through the opening 13 formed in the previous step, as illustrated in FIG. 5. The stuffing 18 may be any conventional material used for stuffing toy animals, or may be a material used for batting in quilts or the like. Illustrated is stuffing 18 cut from a sheet of batting material. By using this type of material, the thickness and breadth of the puff 12 may be more accurately controlled, The puff quilt square 10 is completed by attaching the product of the previous step, a puff quilt square face 16, to a backing 20, as illustrated in FIGS. 6*a* and 6*b*.

Figure 8:
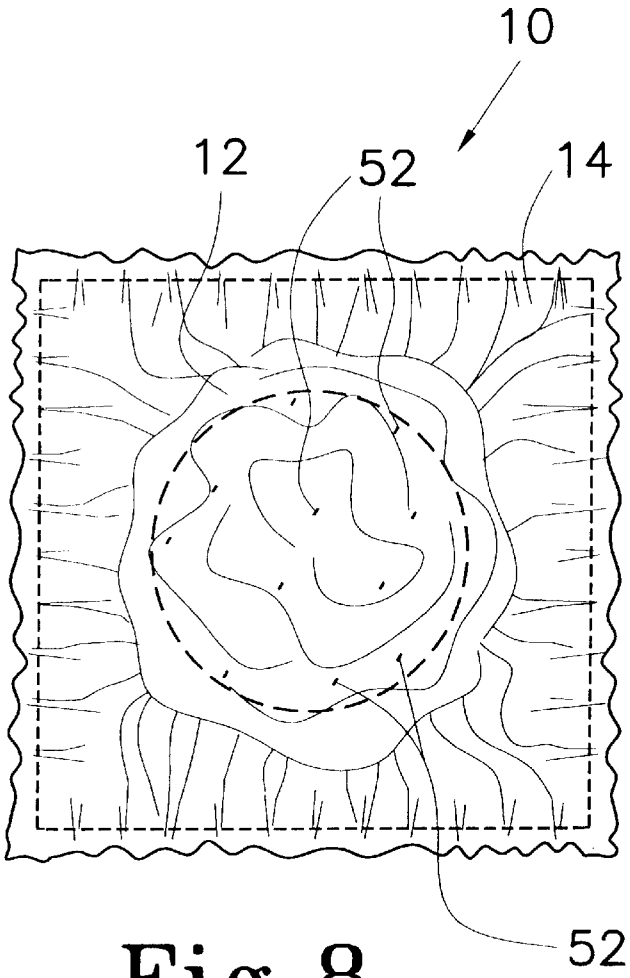
FIG. 8 illustrates a completed puff quilt square on which a rose is simulated.
Figure 9:
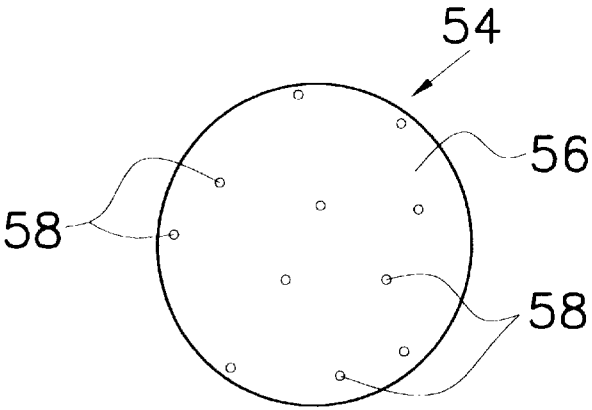
FIG. 9 illustrates an embroidery marking template.
Figure 7:
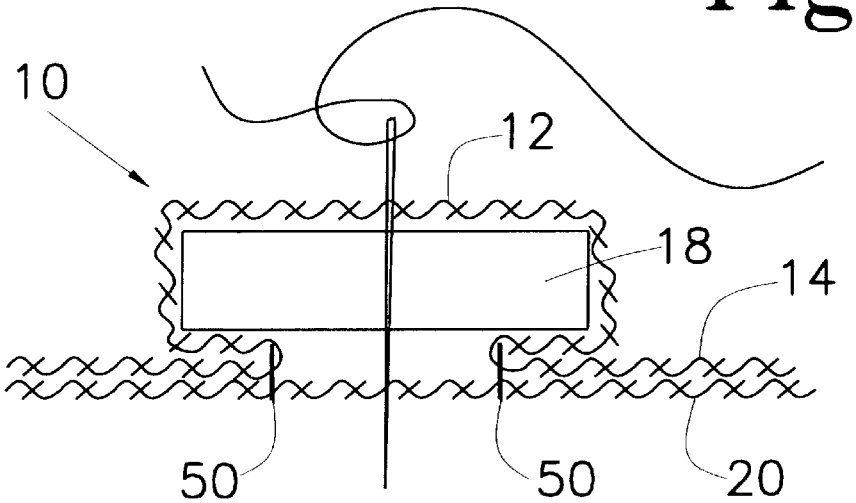
FIG. 7 illustrates the embroidery of a puff quilt square in order to accomplish a selected pattern.

In order to achieve sculpting effects to simulate a particular article, the puff 12 is embroidered as illustrated in FIG. 7. Embroidery stitches 52 are applied through the puff 12, the stuffing material 18, and the backing material 20. As illustrated in FIG. 8, several embroidery stitches 52 are applied to fasten selected spots of the puff 12 to simulate a rose. In order to accomplish identical puffs 12, a template 54 such as that illustrated in FIG. 9 may be used to mark each embroidery location. The embroidery marking template 54 includes a planar member 56 defining a plurality of openings 58, through which the puff 12 is marked. Although spot embroidery is illustrated in FIG. 8, it will be understood that any embroidery pattern may be used. For example, facial features, clothing features, or any other adornment may be created using conventional embroidery methods.

Upon completion of the required number of the puff quilt squares 10, the puff quilt squares 10 are incorporated into the quilt or other article. When used to fabricate a quilt, two puff quilt squares 10 are placed right side together and then sewn together along one edge 26. The puff quilt squares 10 are then unfolded to reveal the individual puffs 12. This method is repeated until the face of the quilt is completed. A quilt backing (not shown) and a quilt batting (not shown) are then placed under the quilt face and sewn in a conventional manner. Of course, any other conventional method of attaching the puff quilt squares 10 may be used with equal success.

Figure 10:
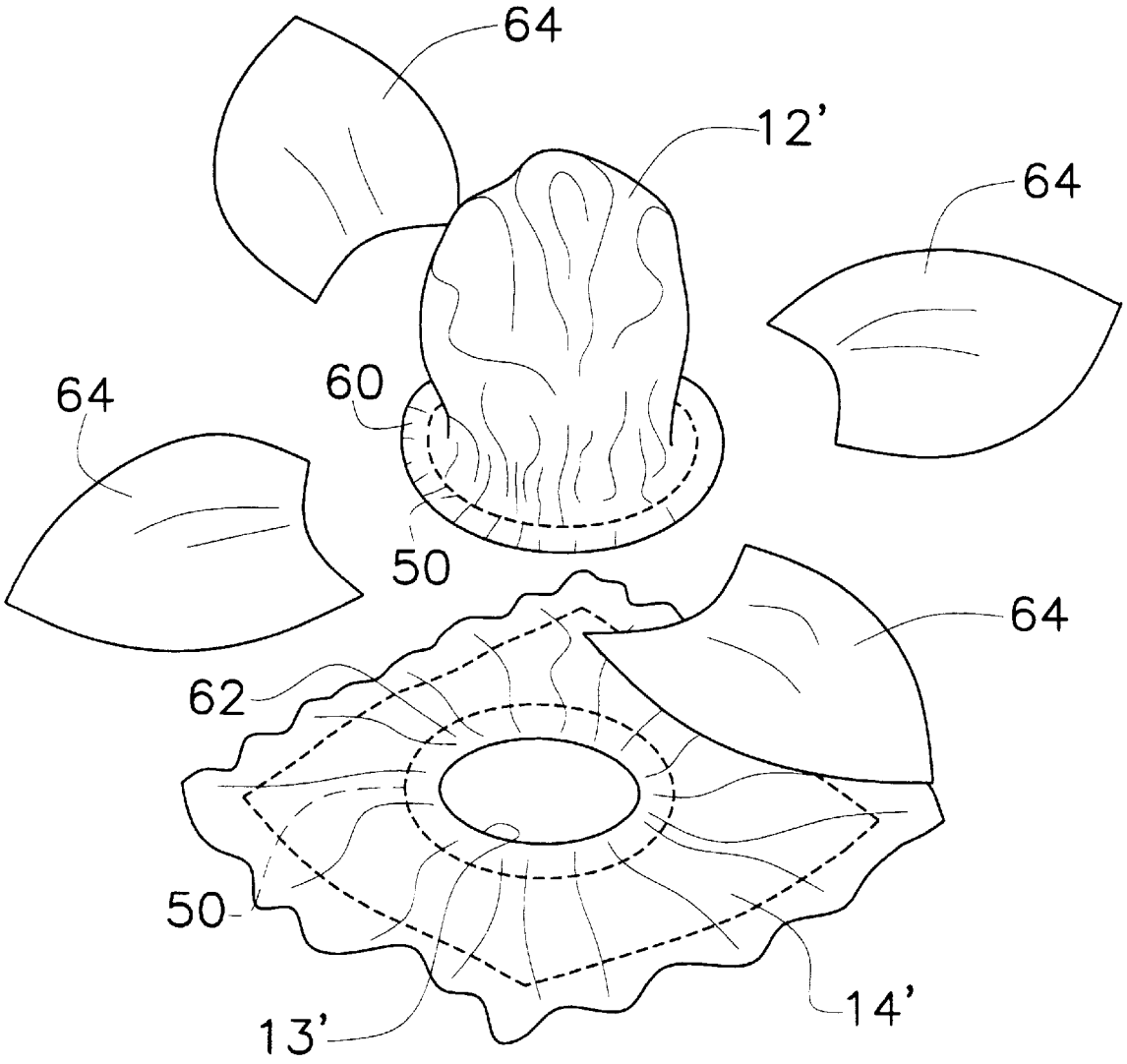
FIG. 10 an exploded view of an alternate embodiment of a puff quilt square face.
Figure 11:
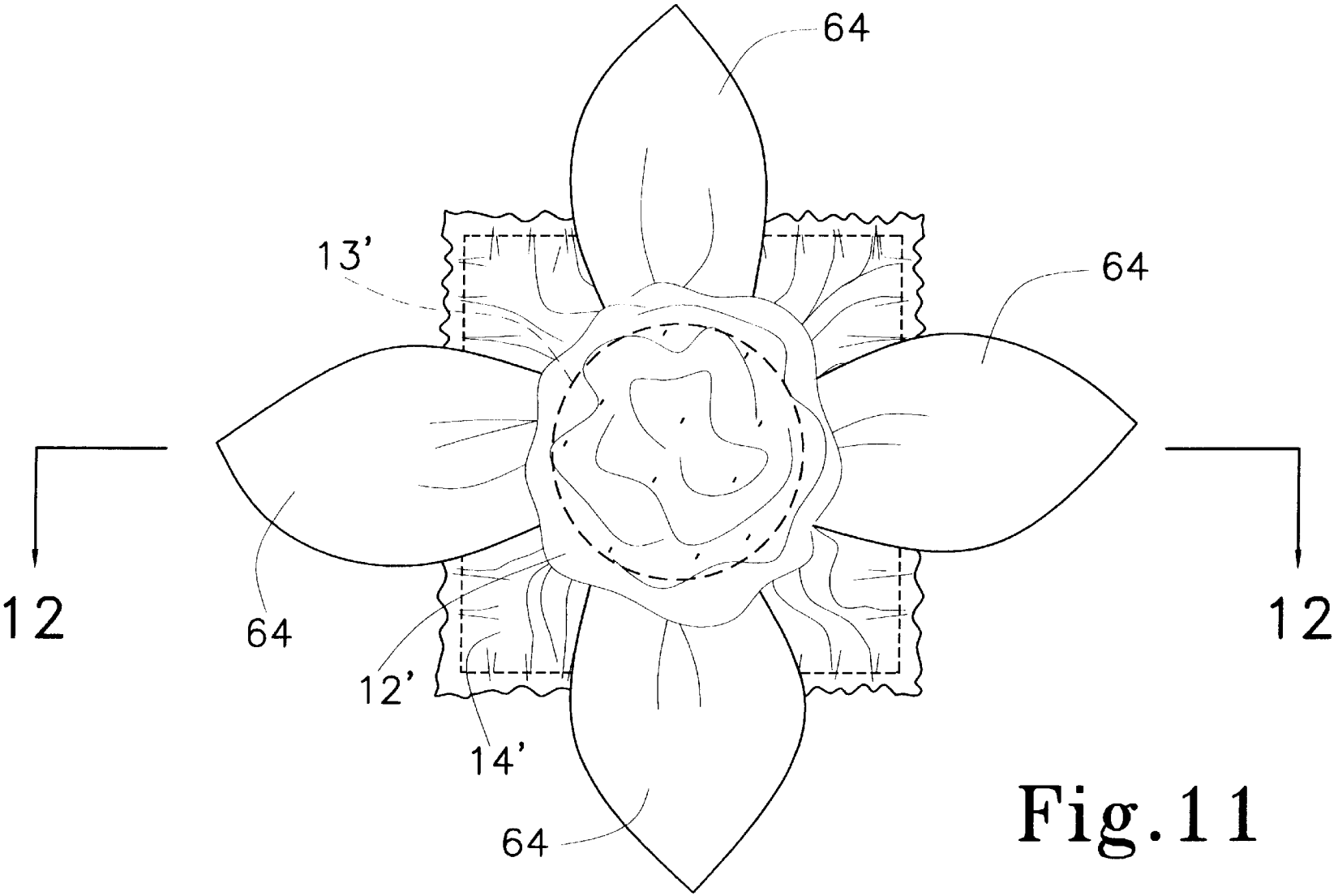
FIG. 11 is a plan view of an assembled puff quilt square face of FIG. 10.
Figure 12:
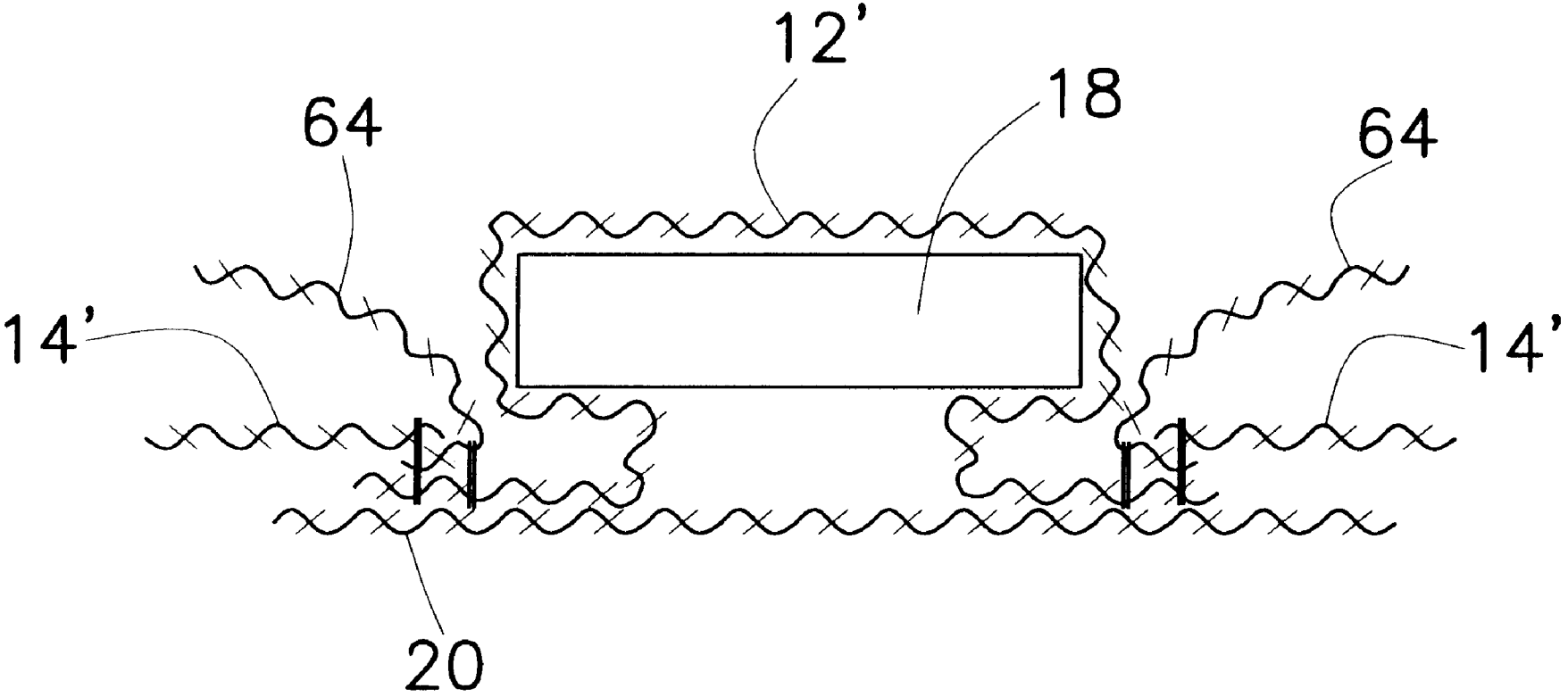
FIG. 12 is a cross-section view, taken at 12—12 of FIG. 11, illustrating the assembly of the various members of the puff quilt square face of FIG. 10, and FIGS. 13*a* and 13*b* illustrate alternate embodiments of the core and guide ring for accomplishing alternate puff designs.

As illustrated in FIGS. 10–12, two puffs 12 may be fabricated in the manner heretofore described, the two puffs 12 being fabricated from materials of different color. From these two puffs 12, one puff 12' is cut from the puff quilt square face 16 on the outside of the stitch 50 formed as described above and illustrated in FIG. 4*a* so as to leave a puff 12' debug a fringe 60. The second puff 12 is cut from its puff quilt square face 16 on the inside of the stitch 50, thereby leaving only a border 14' with a central opening 13' and a fringe 62. At this stage, any number of three dimensional enhancement components 64 may be sewn to the puff 12' in order to enhance the effect of the simulation of the selected plant, animal, person, or other article. For example, in the illustrated embodiment, the components 64 are leaves to enhance the look of the rose previously fabricated. In other embodiments, it will be seen that butterfly or bird wings are appropriate where the puff is in the shape of the body. Likewise, the components 64 may simulate ears, arms, legs, or a tail of other animals. After the components 64 are sewn to the first puff 12' the fringe 60 of the first puff 12' is inserted into the central opening 13' defined by the border 14', and the two pieces are sewn together. This is best illustrated in FIG. 12. Thus, a puff quilt square face 16' is fabricated having a puff 12' of one fabric 24 and a border 14' of another, with three-dimensional enhancement components 64 being sewn therebetween to enhance the overall look of the puff quilt square face 12'.

FIGS. 13*a* and 13*b* illustrate two alternate embodiments of the puff quilt square maker of the present invention. FIG. 10*a* resembles a gingerbread man cookie. The guide ring 46' defines a configuration substantially identical to that of the core (not shown), with a spacing between the core and the guide ring 46' to allow for the passage of the fabric 24', as described above. Due to the low profile of the core, as evident from the low profile of the puff 12', the breadth of the puff 12' is slightly larger than the base of the core. However, in the embodiment of FIG. 10*b*, the height of the core 42" is relatively high compared to the configuration at the base 44" of the core 42". Therefore, a puff 12" fabricated using the puff quilt square maker of FIG. 10*b* will define a breadth substantially greater than the base 44 " of the core 42". It will be seen that as the height of the puff 12" of FIG. 10*b* is increased, however, the breadth is accordingly decreased.

From the foregoing description, it will be recognized by those skilled in the art that a puff quilt square maker and method for using offering advantages over the prior art has been provided. Specifically, the puff quilt square maker and method for using provides a means for manufacturing a puffed article for use in association with the manufacture of a quilted article. The puffed article defines a selected outline and a selected depth.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A puff quilt square maker for fabricating a puff on a quilt square, said puff quilt square maker comprising:

a core defining a selected configuration and a selected height; and a guide ring configured to be closely received about said core, said guide ring being configured to closely receive said core and a piece of fabric placed over said core in order to form a series of gathers and to facilitate sewing of said piece of fabric about said series of gathers proximate to and on an exterior of said guide ring in order to form a puff, after which said guide ring is removed from over said puff and said core, and said core is removed from said puff.

2. The puff quilt square maker of claim 1 further comprising a gathering guide for assisting in fabrication of a selected length of a gathered material, said gathering guide defining a first slit for receiving a first end of a thread and at least one second slit for receiving a second end of said thread, said gathering guide further including a measuring guide for assistance in selecting one of said at least one second slit, said measuring guide including indicia to indicate a distance from said first slit to each of said at least one second slit.

3. The puff quilt square maker of claim 1 further comprising a template for marking at least one embroidery location, said at least one embroidery location defining a feature of a thing being simulated by said puff quilt square.

4. A puff quilt square maker for fabricating a puff on a quilt square, said puff quilt square maker comprising:

a core defining a selected configuration and a selected height;

a guide ring configured to be closely received about said core, said guide ring being configured to closely receive said core and a piece of fabric placed over said core in order to facilitate sewing of said piece of fabric about said guide ring in order to form a puff, after which said guide ring is removed from over said puff and said core, and said core is removed from said puff;

a gathering guide for assisting in fabrication of a selected length of a gathered material, said gathering guide defining a first slit for receiving a first end of a thread and at least one second slit for receiving a second end of said thread, said gathering guide further including a measuring guide for assistance in selecting one of said at least one second slit, said measuring guide including indicia to indicate a distance from said first slit to each of said at least one second slit; and a template for marking at least one embroidery location, said at least one embroidery location defining a feature of a thing being simulated by said puff quilt square.

5. A method for fabricating a puff on a quilt square, said method comprising the steps of:

A) placing a piece of fabric over a core member, said core member defining a selected configuration and a selected height;

B) sliding a guide ring over said fabric to a base of said core member forming a series of gathers about an exterior of said guide ring, said guide ring defining a configuration substantially similar to said core member configuration;

C) sewing said series of gathers of said fabric proximate to and on an exterior of said guide ring to define a puff on one side of said fabric;

D) removing said guide ring from about said fabric and said core member;

E) removing said core member from within said puff;

F) filling said puff with a stuffing material; and

G) securing a backing material to said fabric on a side thereof opposite said puff.

6. The method of claim 5, before said step of placing a piece of fabric over a core member, further comprising the step of gathering each edge of said piece of fabric.

7. The method of claim 5, before said step of placing a piece of fabric over a core member, further comprising the step of marking said piece of fabric with at least one alignment mark, and after said step of placing a piece of fabric over a core member, further comprising the step of aligning said at least one alignment mark with a corresponding location defined by said core member.

8. The method of claim 5, after said step of removing said core member from within said puff further comprising the steps of:

1) cutting around said puff to define a first puff having a fringe;

2) repeating said step of placing a piece of fabric over a core member through said step of removing said core member from within said puff;

3) cutting said puff from said piece of fabric to define a border having a central opening;

4) placing said first puff fringe into said border central opening; and 5) sewing said first puff to said border.

9. The method of claim 8, between said step of placing said first puff fringe into said border central opening and said step of sewing said first puff to said border, further comprising the step of sewing at least one three-dimensional enhancement component to said first puff fringe.

10. The method of claim 5, after said step of securing a backing material to said fabric on a side thereof opposite said puff, further comprising the step of embroidering at least one feature of a thing being simulated by said puff quilt square.

11. A puff quilt square maker for fabricating a puff on a quilt square, said puff quilt square maker comprising:

a core defining a selected configuration and a selected height;

a guide ring configured to be closely received about said core, said guide ring being configured to closely receive said core and a piece of fabric placed over said core in order to facilitate sewing of said piece of fabric about said guide ring in order to form a puff, after which said guide ring is removed from over said puff and said core, and said core is removed from said puff; and a gathering guide for assisting in fabrication of a selected length of a gathered material, said gathering guide defining a first slit for receiving a first end of a thread and at least one second slit for receiving a second end of said thread, said gathering guide further including a measuring guide for assistance in selecting one of said at least one second slit, said measuring guide including indicia to indicate a distance from said first slit to each of said at least one second slit.

12. A method for fabricating a puff on a quilt square, said method comprising the steps of:

A) gathering each edge of said piece of fabric;

B) placing a piece of fabric over a core member, said core member defining a selected configuration and a selected height;

C) sliding a guide ring over said fabric to a base of said core member, said guide ring defining a configuration substantially similar to said core member configuration;

D) sewing said fabric proximate said guide ring to define a puff on one side of said fabric;

E) removing said guide ring from about said fabric and said core member;

F) removing said core member from within said puff;

G) filling said puff with a stuffing material; and

H) securing a backing material to said fabric on a side thereof opposite said puff.

13. The method of claim 12, before said step of placing a piece of fabric over a core member, further comprising the step of marking said piece of fabric with at least one alignment mark, and after said step of placing a piece of fabric over a core member, further comprising the step of aligning said at least one alignment mark with a corresponding location defined by said core member.

14. The method of claim 12, after said step of removing said core member from within said puff further comprising the steps of:

1) cutting around said puff to define a first puff having a fringe;

2) repeating said step of placing a piece of fabric over a core member through said step of removing said core member from within said puff;

3) cutting said puff from said piece of fabric to define a border having a central opening;

4) placing said first puff fringe into said border central opening; and 5) sewing said first puff to said border.

15. The method of claim 14, between said step of placing said first puff fringe into said border central opening and said step of sewing said first puff to said border, further comprising the step of sewing at least one three-dimensional enhancement component to said first puff fringe.

16. A method for fabricating a puff on a quilt square, said method comprising the steps of:

A) marking said piece of fabric with at least one alignment mark;

B) placing a piece of fabric over a core member, said core member defining a selected configuration and a selected height;

C) aligning said at least one alignment mark with a corresponding location defined by said core member;

D) sliding a guide ring over said fabric to a base of said core member, said guide ring defining a configuration substantially similar to said core member configuration;

E) sewing said fabric proximate said guide ring to define a puff on one side of said fabric;

F) removing said guide ring from about said fabric and said core member;

G) removing said core member from within said puff;

H) filling said puff with a stuffing material; and

I) securing a backing material to said fabric on a side thereof opposite said puff.

17. The method of claim 16, after said step of removing said core member from within said puff further comprising the steps of:

1) cutting around said puff to define a first puff having a fringe;

2) repeating said step of placing a piece of fabric over a core member through said step of removing said core member from within said puff;

3) cutting said puff from said piece of fabric to define a border having a central opening;

4) placing said first puff fringe into said border central opening; and 5) sewing said first puff to said border.

18. The method of claim 17, between said step of placing said first puff fringe into said border central opening and said step of sewing said first puff to said border, further comprising the step of sewing at least one three-dimensional enhancement component to said first puff fringe.

19. The method of claim 18, after said step of marking said piece of fabric with at least one alignment mark and before said step of placing a piece of fabric over a core member, further comprising the step of gathering each edge of said piece of fabric.

20. A method for fabricating a puff on a quilt square, said method comprising the steps of:

A) placing a piece of fabric over a core member, said core member defining a selected configuration and a selected height;

B) sliding a guide ring over said fabric to a base of said core member, said guide ring defining a configuration substantially similar to said core member configuration;

C) sewing said fabric proximate said guide ring to define a puff on one side of said fabric;

D) removing said guide ring from about said fabric and said core member;

E) removing said core member from within said puff;

F) cutting around said puff to define a first puff having a fringe;

G) repeating said step of placing a piece of fabric over a core member through said step of removing said core member from within said puff;

H) cutting said puff from said piece of fabric to define a border having a central opening;

I) placing said first puff fringe into said border central opening;

J) sewing said first puff to said border;

K) filling said puff with a stuffing material; and

L) securing a backing material to said fabric on a side thereof opposite said puff.

21. The method of claim 20, between said step of placing said first puff fringe into said border central opening and said step of sewing said first puff to said border, further comprising the step of sewing at least one three-dimensional enhancement component to said first puff fringe.

* * * * *